US008604680B1

(12) United States Patent
Krusos et al.

(10) Patent No.: US 8,604,680 B1
(45) Date of Patent: Dec. 10, 2013

(54) REFLECTIVE NANOSTRUCTURE FIELD EMISSION DISPLAY

(75) Inventors: Denis A. Krusos, Melville, NY (US); Anthony J. Campisi, Melville, NY (US); Sergey L. Shokhor, Melville, NY (US)

(73) Assignee: Copytele, Inc., Melville, NY (US)

( * ) Notice: Subject to any disclaimer, the term of this patent is extended or adjusted under 35 U.S.C. 154(b) by 900 days.

(21) Appl. No.: 12/660,730

(22) Filed: Mar. 3, 2010

(51) Int. Cl.
*H01J 9/02* (2006.01)

(52) U.S. Cl.
USPC ..... 313/310; 313/495; 313/346 R

(58) Field of Classification Search
USPC ..... 313/495–497, 306, 309–310, 346, 351, 313/355
See application file for complete search history.

(56) References Cited

U.S. PATENT DOCUMENTS

| | | | | |
|---|---|---|---|---|
| 6,674,242 | B2 | 1/2004 | Kastalsky et al. | |
| 6,693,386 | B2 | 2/2004 | DiSanto et al. | |
| 7,156,715 | B2 * | 1/2007 | Lee et al. | 445/24 |
| 7,808,169 | B2 * | 10/2010 | Hirose et al. | 313/309 |
| 7,868,532 | B2 * | 1/2011 | Kim et al. | 313/495 |
| 7,902,737 | B2 * | 3/2011 | Lee | 313/495 |
| 7,969,084 | B2 * | 6/2011 | Kim et al. | 313/495 |
| 7,994,696 | B2 * | 8/2011 | Park et al. | 313/495 |
| 8,148,904 | B2 * | 4/2012 | Yang et al. | 315/169.3 |
| 2003/0178945 | A1 * | 9/2003 | DiSanto et al. | 315/169.1 |
| 2004/0104668 | A1 * | 6/2004 | Lee et al. | 313/496 |
| 2005/0067937 | A1 * | 3/2005 | Sheu et al. | 313/309 |
| 2005/0093424 | A1 * | 5/2005 | Moon | 313/495 |
| 2005/0110392 | A1 * | 5/2005 | Moon | 313/495 |
| 2005/0174028 | A1 * | 8/2005 | Jung et al. | 313/309 |
| 2007/0018565 | A1 * | 1/2007 | Cho et al. | 313/497 |
| 2007/0035231 | A1 * | 2/2007 | Song et al. | 313/496 |
| 2008/0108271 | A1 * | 5/2008 | Kang et al. | 445/51 |
| 2009/0134774 | A1 * | 5/2009 | Ciampa et al. | 313/496 |
| 2009/0273298 | A1 * | 11/2009 | Yang et al. | 315/265 |

* cited by examiner

*Primary Examiner* — Anne Hines
*Assistant Examiner* — Jose M Diaz
(74) *Attorney, Agent, or Firm* — Law Office of Carl Giordano, PC

(57) ABSTRACT

A pixel element includes a substrate layer, a reflector layer, and an emitter layer, electrically isolated from the reflector layer. A first potential is applied to the reflector layer, wherein a potential difference between the emitter layer and the corresponding one reflector layer is operable to draw electrons from the emitter layer to the corresponding reflector layer. The pixel element also includes a transparent layer oppositely positioned a predetermined distance from the emitter layer. The transparent layer has a conductive layer deposited thereon. A second potential is applied to the conductive layer to attract electrons reflected from the reflective layer. The pixel element also includes at least one phosphor layer on the conductive layer oppositely opposed to the corresponding reflector layer. The emitter layer includes a plurality of nanostructures.

38 Claims, 6 Drawing Sheets

REFLECTIVE NANOSTRUCTURE FIELD EMISSION DISPLAY

FIELD OF THE INVENTION

The present invention relates generally to solid-state displays, and more specifically, to reflective nanostructure emission pixel elements.

BACKGROUND OF THE INVENTION

Solid state and non-Cathode Ray Tube (CRT) display technologies are well-known in the art. Light Emitting Diode (LED) displays, for example, include semiconductor diode elements that may be arranged in configurations to display alphanumeric characters. Alphanumeric characters are then displayed by applying a potential or voltage to specific elements within the configuration. Liquid Crystal Displays (LCD) are composed of a liquid crystal material sandwiched between two sheets of a polarizing material. When a voltage is applied to the sandwiched materials, the liquid crystal material aligns in a manner to pass or block light. Plasma displays conventionally use a neon/xenon gas mixture housed between sealed glass plates that have parallel electrodes deposited on the surface.

Passive matrix displays and active matrix displays are flat panel displays that are used extensively in laptop and notebook computers. In a passive matrix display, there is a matrix or grid of solid-state elements in which each element or pixel is selected by applying a potential to a corresponding row and column line that forms the matrix or grid. In an active matrix display, each pixel is further controlled by at least one transistor and a capacitor that is also selected by applying a potential to a corresponding row and column line. Active matrix displays provide better resolution than passive matrix displays, but they are considerably more expensive to produce.

While each of these display technologies has advantages, such as low power and lightweight, they also have characteristics that make them unsuitable for many other types of applications. Passive matrix displays have limited resolution, while active matrix displays are expensive to manufacture.

The edge emitter FED pixel element disclosed in U.S. patent application Ser. No. 10/102,450, now U.S. Pat. No. 6,674,242, entitled "Field-Emission Matrix Display Based on Electron Reflection," is representative of a pixel element that may be included in a low-cost, lightweight, high-resolution display system. In such a display, a high screen brightness with a minimum power consumption is advantageous. One method for achieving a high screen brightness is to concentrate the reflected electron beam onto an associated phosphor layer with little or no scattering, or cross-talk, of the electron beam from one pixel element into adjacent pixel elements, or as will be appreciated, an adjacent sub-pixel element.

SUMMARY OF THE INVENTION

The present invention relates to a reflective emission pixel element. The pixel element includes a substrate layer, at least one reflector layer, and at least one emitter layer, electrically isolated and positioned above a corresponding one of the at least one reflector layer. The at least one emitter layer circumjacents the at least one reflector layer. The pixel element also includes means for applying a first potential to the at least one reflector layer, wherein a potential difference between the at least one emitter layer and the corresponding one of the at least one reflector layer is operable to draw electrons from the at least one emitter layer to the corresponding one of the reflector layer. The pixel element also includes a transparent layer oppositely positioned a predetermined distance from the at least one emitter layer. The transparent layer has a conductive layer deposited thereon. The pixel element also includes means for applying a second potential to the conductive layer to attract electrons reflected from the at least one reflective layer. The pixel element also includes at least one phosphor layer on the conductive layer oppositely opposed to the corresponding one of the at least one reflector layer. The at least one emitter layer includes a plurality of nanostructures.

In another aspect of the invention, a reflective edge Field Emission Display (FED) is provided. The FED includes a substrate layer having fabricated thereon a plurality of reflective pixel elements arranged in a matrix of rows and columns thereon. Each of the pixel elements identified by a row and a column designation includes at least one reflector layer deposited on the substrate and an emitter layer electrically isolated from and operable to emit electrons therefrom and shaped to bound a corresponding one of the at least one reflector layer. The emitter layer includes a plurality of nanostructures. The FED also includes a transparent layer electrically isolated from the substrate layer, having deposited thereon at least one conductive layer, and a phosphor layer associated with each of said at least one conductive layer, wherein said phosphor layer is oppositely opposed to a corresponding one of said at least one reflector layer. The FED also includes at least one non-conductive spacer selectively positioned between the substrate layer and the transparent layer to maintain a substantially desired distance between the substrate layer and the transparent layer. The FED also includes a seal between the substrate layer and the transparent layer operative to sustain a vacuum therebetween.

Figure 1A:
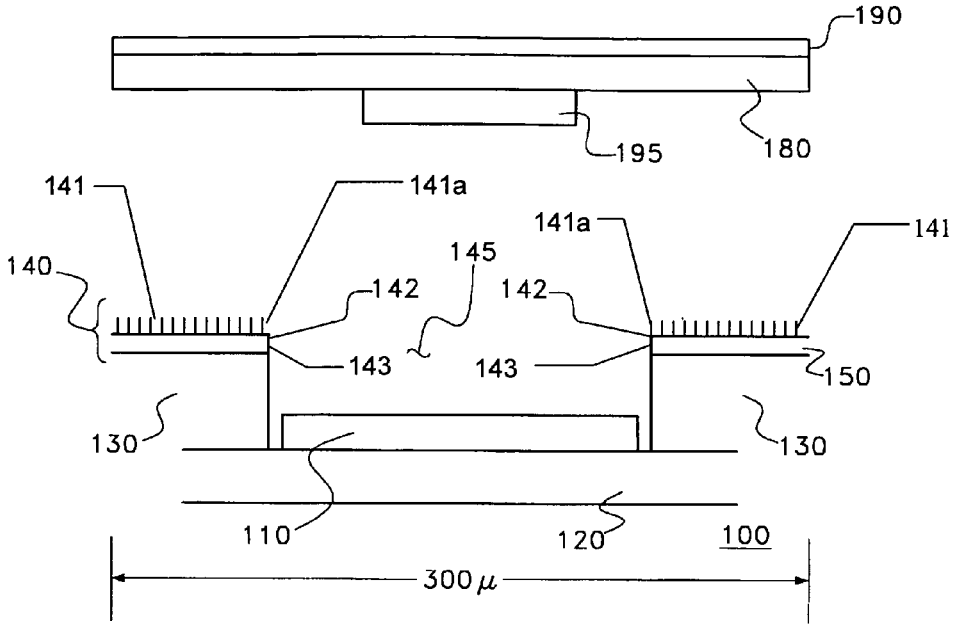
FIGS. 1*a* and 1*b* illustrate cross-sectional views of different embodiments of Field-Emission Display (FED) pixel element in accordance with the principles of the invention.

It is to be understood that these drawings are solely for purposes of illustrating the concepts of the invention and are not intended as a definition of the limits of the invention. It will be appreciated that the same reference numerals, possibly supplemented with reference characters where appropriate, have been used throughout to identify corresponding parts.

DETAILED DESCRIPTION OF THE INVENTION

FIG. 1*a* illustrates a cross-sectional view of a Reflective Nanostructure Field Emission Display (FED) pixel element 100 in accordance with the principles of the invention. In this exemplary embodiment, pixel element 100 is fabricated by depositing at least one reflective layer 110 on a dielectric or non-conductive substrate 120, e.g. glass, silicon dioxide ($SiO_2$). Reflective layer 110 is representative of an electrode that may also be used to control a voltage or potential applied to pixel elements 100 that are arranged in a row or column, which are oriented orthogonal to the plane of FIG. 1*a*, as will more fully be explained. Reflective electrode 110 may be any material possessing a high electrical conductivity and reflectivity selected from a group of metals, such as, gold, silver, aluminum, vanadium, niobium, chromium, molybdenum, etc. In one embodiment, reflective layer 110 is formed from niobium.

Insulator layer 130, which is made of silicon dioxide, $SiO_2$, is next deposited on reflective layer 110. Insulator layer 130 electrically isolates reflective layer 110 and is in the range of about 0.5 microns thick. Emitter layer 140 is next deposited on insulating layer 130. Emitter layer 140 is of a material that is operative to emit electrons when a sufficient potential difference exists between reflective layer 110 and emitter layer 140. Emitter layer 140 is preferably selected from materials that emit electrons when a potential difference exists between reflector layer 110 and emitter layer 140.

In the illustrated embodiment, emitter layer 140 is comprised preferably of a bottom conductive layer 150 and nanostructures 141. The nanostructures 141 are placed on the conductive layer 150 and may take the form of carbon nanotubes, for example. The nanostructures may take the form of single walled carbon nanotubes (SWCNTs) or multi walled carbon nanotubes or (MWCNTs). Nanotubes 141 are known to possess extremely low threshold voltages in the order of 1-3 V/micron for electron emission. The innermost nanotubes 141*a* (i.e., closest to the reflector layer 110) are vertically aligned with the inner lateral edge 143 (i.e., closest to the reflector layer). The innermost nanotubes 141*a* and conductive layer 150 extend radially inward with respect to a vertical axis of the reflector layer 110 in close proximity to the reflector surface such that a small gap laterally separates the innermost nanotubes 141*a* and peripheral edge of the reflector layer 110. The nanostructures 141 may be applied to the conductive layer 150 using any conventional methodology, such as spraying, growth, electrophoresis, or printing, for example. Conductive layer 150 is representative of an electrically conductive material that provides an electrical contact to the nanostructures 141 and may be used as a column or row connector in a FED display, as will be further explained.

Pixel well 145 is next created by etching, for example using photo-resistant patterning, through emitter layer 140 and insulator film layer 130 to expose reflector layer 110. Emitter layer 140 is etched or shaped such that it borders on all sides, i.e., circumjacent, to exposed reflector layer 110. Photo-resistant patterning is well known in the art and need not be discussed in detail herein. Pixel 100 is in the order of 300×300 microns.

As will be appreciated, the exposed width of reflector layer 110 may be determined by appropriately timing the etching of insulating layer 130. A transparent electrode, which is made of Indium tin oxide (ITO) 180 is deposited on transparent plate 190, e.g., glass. ITO layer 180 is an optically transparent conductive material that may be used to provide a known potential in selective areas of ITO 180.

Phosphor layer 195 is then deposited on ITO 180. Phosphor layer 195 produces a predetermined or desired level of photonic activity or illumination when activated or bombarded by impinging electrons. In a preferred aspect, phosphor layer is deposited such that it is opposite a corresponding pixel well 145.

Although not shown, it would be appreciated that a dielectric material, such as $SiO_2$, may be selectively placed as spacers to electrically separate transparent substrate 190 and emitter layer 140.

The confined pixel volume contained between pixel well 145 and transparent surface 190 is further evacuated to a pressure in the range of, $10^{-5}$ to $10^{-7}$, and preferably, $10^{-6}$ torr. Methods for evacuating the gases within a sealed pixel element are well known in the art and need not be discussed in detail.

In the operation of pixel element 100, the application of a positive voltage or potential to reflective layer 110 relative to emitter layer 140 creates an electrical field that draws electrons from the emitter layer 140 to reflective layer 110. All of the nanostructures 141 potentially emit electrons when sufficient positive voltage is applied to the reflector relative to the emitter layer 140. Electrons reflected from reflective layer 110 are then attracted to a positive voltage applied to ITO layer 180, which in turn bombard phosphor layer 195. It will be appreciated that emitter layer 140 and reflective layer 110 may be held at a known potential difference which is not sufficient to cause the emission of electrons from emitter layer 140. An additional voltage, in the form of a pulse, may then be applied to reflective layer 110 to create a potential difference sufficient for emitter layer 140 to emit electrons.

As will be appreciated, the gap between the innermost nanotubes 141*a* and reflector layer 110 can be made extremely small, preferably less than or equal to one (1) micron. In this case, the voltage or potential difference between the nanotubes 141 and reflector layer 110 can be reduced to a level between 10-40 volts. According to an aspect of the invention, the potential between emitter layer 140 and reflector layer 110 is in the order of 10-40 volts. The potential of the combined phosphor 195/ITO layer 180 may be kept at a significantly higher voltage to attract reflected electrons to a corresponding phosphor layer to illuminate substantially the entire phosphor layer corresponding to the pixel element without reflected electrons being spread into an adjacent pixel element phosphor layer.

Figure 4:
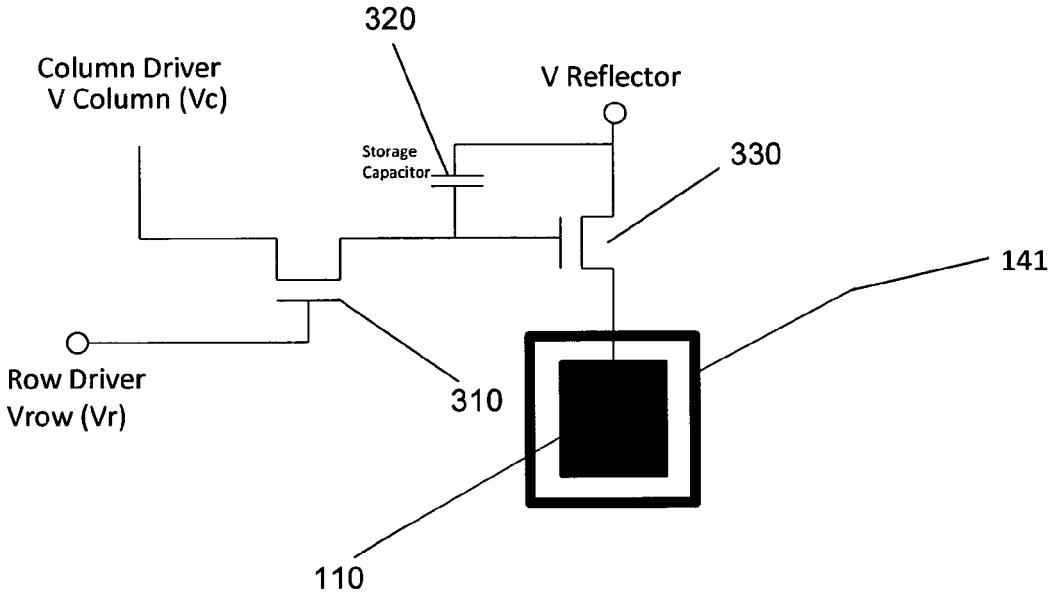
FIG. 4 illustrates a schematic view of a circuit used to control an active thin film transistor (TFT) display of the present invention.

For an active thin film transistor (TFT) display, the reflector 110 in FIG. 1*a* becomes the thin film transistor pixel which also has memory. Control of one or more TFT associated with the display device of the present invention may be accomplished using the circuit 300 of FIG. 4. Circuit 300 includes first and second transistors 310, 330 and a storage capacitor 320 electrically interconnected with the reflector 110, which is surrounded by the nanostructure emitter 141. The storage capacitor 320 operates to hold the charge on each pixel for an entire frame. The voltage (Vr) used to select the row is equal to the fully "on" voltage (Vc) of the column. The row voltage Vr in this circuit 300 causes the pass transistor 310 to conduct. The resistance of transistor 310, the capacitor 320 and the write time of each selected row determines the voltage at the gate of transistor 330 as compared to Vc. Using a row voltage Vr higher than the fully "on" voltage (Vc) increases the conduction of transistor 310, reducing its resistance and resulting in an increase in pixel voltage and enhanced brightness.

Figure 1B:
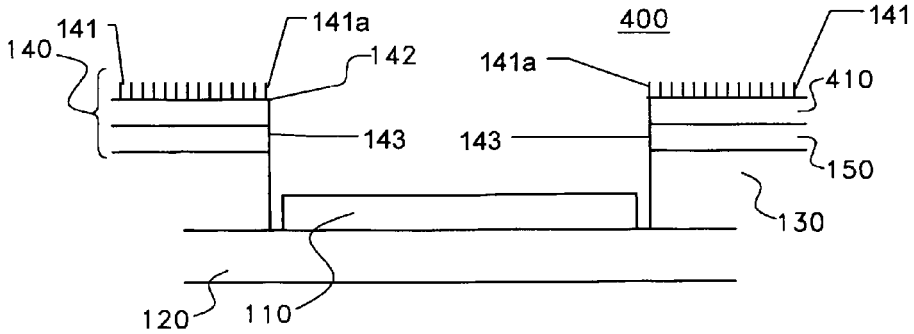

FIG. 1*b* illustrates an alternative embodiment 400 of the present invention in which emitter layer 140 is composed of a resistive material 410, such as alpha-silicon (α-Si), imposed between the conductive layer 150 and the nanostructures 141, of FIG. 1*a*.

Figure 2A:
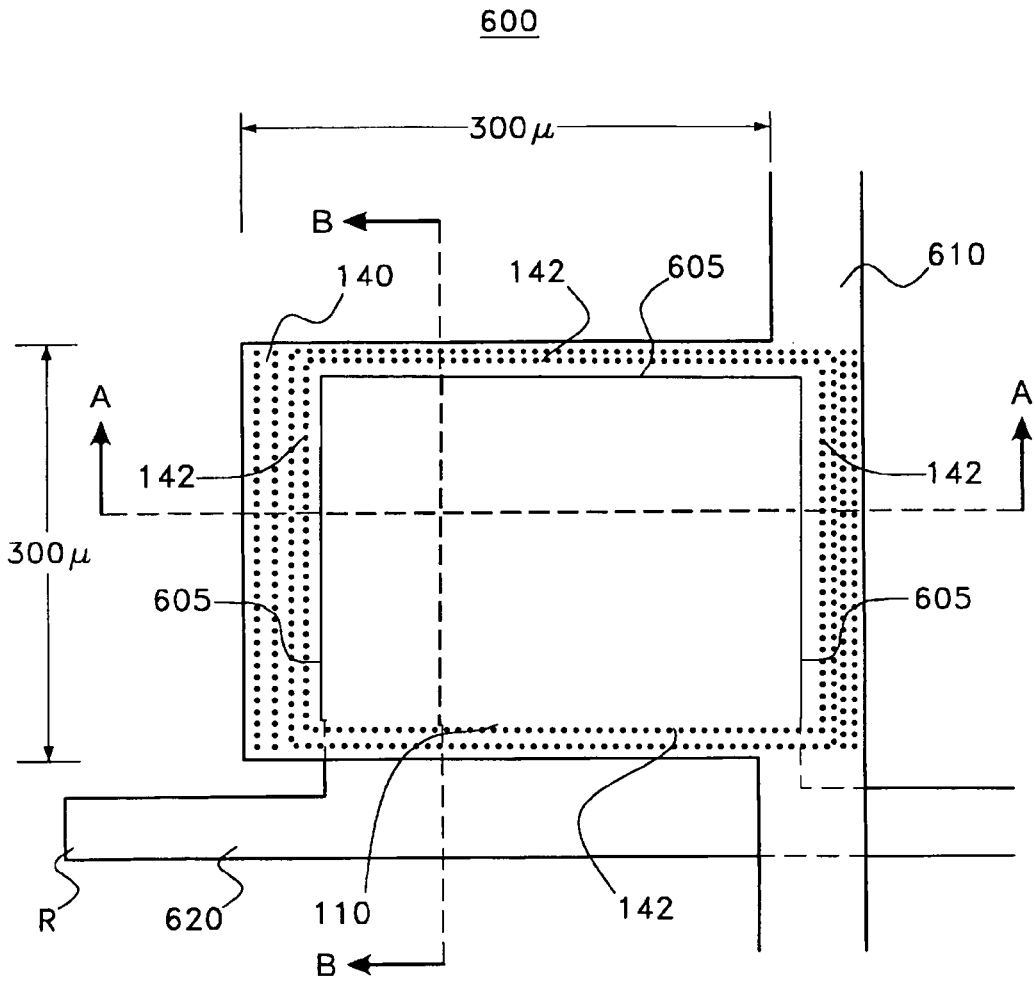
FIG. 2*a* illustrates a top view of the shaped-emitter pixel element in accordance with the principles of the invention.

FIG. 2*a* illustrates a top view of a pixel element 600 in accordance with the principles of the invention. Innermost edges 142 of the emitter layer 140 extend in close proximity to the edge 605 of reflective layer 110. Emitter layer 140 is further shaped to form a perimeter that is vertically offset from the reflective surface of the reflector layer 110 and around the reflective surface of reflector layer 110. In this aspect, the reflective surface is substantially contained within the perimeter boundary determined by the edges 142 of the emitter layer 140. A potential or voltage applied to emitter layer 140 thus creates an electrical barrier that restrains, or confines, the direction of electrons reflected from reflector layer 110 to remain within the bounds of edges 142. Restraint or containment of the reflected electron beam substantially within the bounds of edges 142 is advantageous as it limits the spread of the electron beam and reduces cross-talk between pixel element or sub-pixel elements in color displays, as will be shown.

Further illustrated is that emitter layer 140 may be in electrical communication with similar pixel elements (not shown) by at least one column line 610 and reflective layer 110 may be in electrical communication with similar pixel elements (not shown) by row lines 620. Pixel element 100 may be identified or addressed in a display unit composed of a matrix of similar pixel elements by its row identifier and its column identifier. Pixel element 600 may also be identified by a plurality of emitter layers 140 connected in rows and reflector layers 110 connected in columns.

Figure 2B:
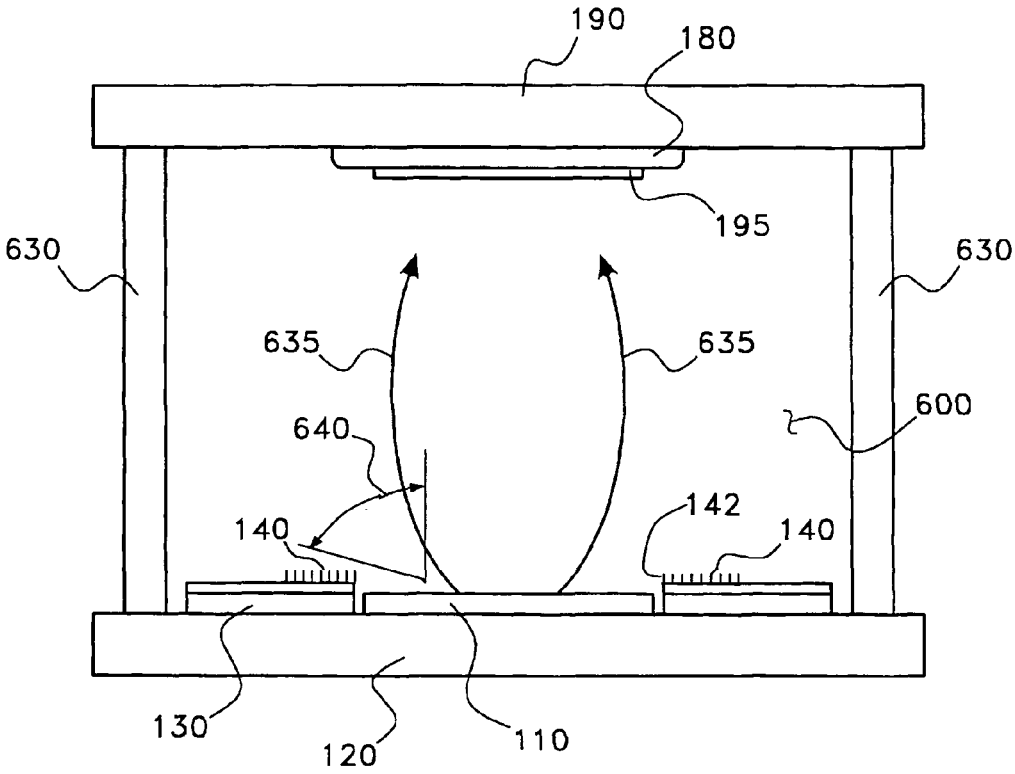
FIG. 2*b* illustrates a cross-section of the shaped-emitter pixel element of FIG. 2*a*.

FIG. 2*b* illustrates a cross-sectional view through section A-A of the pixel element 600 shown in FIG. 2*a*, showing paths of electrons reflected from reflector layer 110. In this case, electrons 635 emitted from emitter layer 140 are attracted to, and reflected from, reflector layer 110. The path of electrons reflected from reflector layer 110 at an initial angle substantially different than 90 degrees, as illustrated by angle 640, may be directed or deflected by the potential difference between the reflected electron and the potential or voltage applied to emitter layer 140 to a substantially perpendicular direction of travel to ITO layer 180. Hence, electrons 635 may be substantially maintained within the bounds of emitter layer 140 and as fewer electrons 635 penetrate the electrical barrier created by shaped-emitter layer 140 less interference with adjacent phosphor layers occurs and more electrons strike the desired phosphor layer 195.

Also illustrated are spacers 630, which provide electrical separation of the electrically conductive ITO layer 180 and emitter layer 140. Spacers 630 are conventionally fabricated from a dielectric material, such as $SiO_2$, and further provide mechanical support to transparent layer 190 when the volume between transparent layer 190 and pixel well 145 is evacuated to create a vacuum therein.

Although not shown, it would be appreciated that a cross-section view through section B-B of FIG. 2*a* would provide a similar deflection of reflected electrons. Hence, reflected electrons are restrained in both a lateral and orthogonal direction.

Figure 3A:
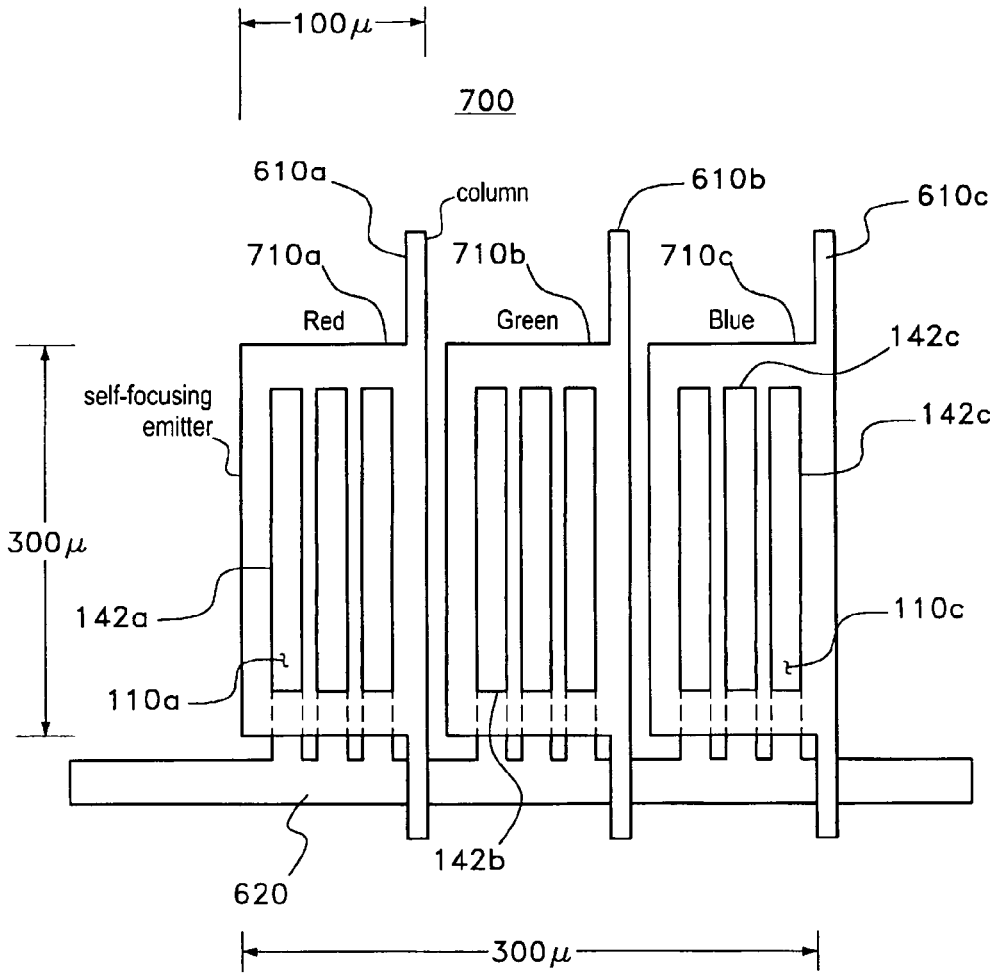
FIG. 3*a* illustrates a top view of shaped-emitter pixel elements for color pixel elements taken along line C-C of FIG. 3*b* in accordance with the principles of the invention.

FIG. 3*a* illustrates a top view of another embodiment 700 of a color FED pixel element in accordance with the principles of the present invention. In this embodiment, pixel 700 is partitioned into three sub-pixel elements, represented as 710*a*, 710*b*, 710*c*, which may be associated with red, green and blue phosphor layers, i.e., RGB.

In a FED display system, each sub-pixel element is independently controlled by column lines 610*a*, 610*b*, 610*c* and row line 620. Each sub-pixel emitter edge, represented as 142*a*, 142*b*, 142*c*, respectively, operates as previously described to prevent electrons emitted from a corresponding reflector layer 110*a*, 110*b*, 110*c*, to impinge upon the phosphor layers corresponding to an adjacent sub-pixel element phosphor layer. To maintain a desired 330.times.330 micron pixel size, each sub-pixel element 710*a*, 710*b*, 710*c*, is in the order of 330.times.110 microns.

Figure 3B:
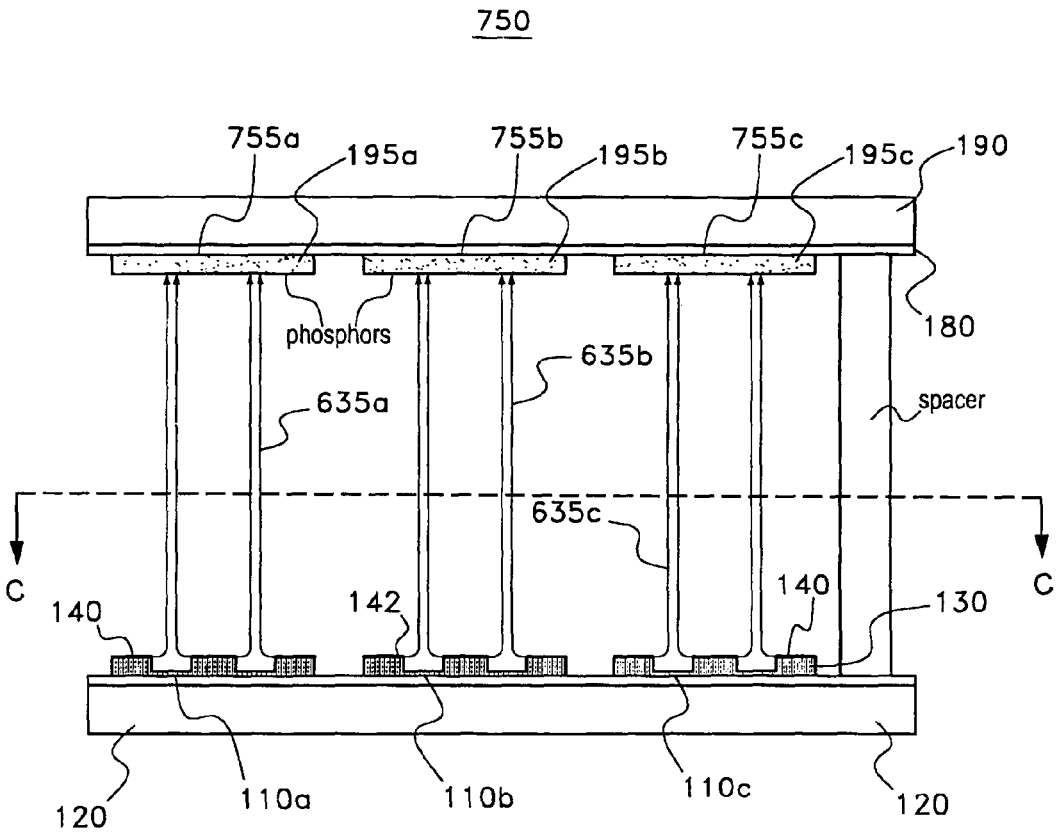
FIG. 3*b* illustrates a cross section of the shaped-emitter pixel elements for color pixel elements of FIG. 3*a*.

FIG. 3*b* illustrates a cross-sectional view of embodiment shown in FIG. 3*a*, which depicts the containment of electron beams, 635*a*, 635*b*, 635*c*, reflected from corresponding reflector layers 110*a*, 110*b*, 110*c*, as they are attracted to phosphor layers 755*a*, 755*b*, 755*c*. In a preferred embodiment phosphor layers 755*a*, 755*b*, 755*c* emit a light in a band corresponding to one of the primary colors, i.e., red, green, blue. As would be appreciated the selection of colors and the order of the color phosphor layers may be exchanged without altering the scope of the invention.

Returning to FIG. 2*b*, it will be understood, that the confinement of the electron path by shaped-emitter layer 140 is not exact and electrons 635 may continue toward ITO layer 180 on a path that may not be substantially perpendicular to reflector layer 110. Hence, electron beam paths may cross before reaching the corresponding phosphor layer. One factor where electron beams may cross is the voltage or potential applied to ITO layer 180 as this voltage determines the level of attraction of electrons to ITO layer 180. Thus, the electrons beam may be focused to a point between ITO layer 180 and reflector layer 110. Hence, to have a maximum number of electrons strike a corresponding phosphor layer, ITO layer 180 may be positioned approximately at the electron focal point.

Accordingly, for a desired distance between ITO layer 180 and reflector layer 110, the voltage on ITO layer 180 may be selected to achieve a desired level of focus or image sharpness. As the distance between emitter layer 140 and reflector layer 110 is typically in the order of 1-2 microns, there is a much greater distance between emitter layer 140 and ITO layer 180.

The relatively high voltage on ITO layer 180 requires high-voltage phosphor, similar to that used on Cathode Ray Tubes (CRT), rather than the low-voltage phosphor used in current solid-state display technology. The high voltage and high-voltage phosphor is advantageous as it enables the electrons to penetrate deeper into the phosphor layer and reduces the emission of impurities into the evacuated FED pixel element, which occurs when electrons bombard the phosphor. High-voltage phosphor having low sulfur content is preferred.

As would be understood by those skilled in the art, a sold-state flat panel display using reflected electron FED pixel elements disclosed herein may be formed by arranging a plurality of reflective edge pixel elements 100, wherein emitter layers 140 are electrically connected in rows and reflector layers 110 are electrically connected in columns. The pixel elements may be formed on a single dielectric surface having spacers positioned thereon to establish a desired distance between pixel elements and transparent layer 190. The spacers further provide mechanical support when the space between the pixel elements and the transparent surface 190 is evacuated and a vacuum is contained therein.

Pixel elements may then be selected to produce an image viewable through transparent layer 190 by the application of voltages to selected rows and columns. Control of selected rows and columns may be performed by any means, for example, a processor, through appropriate row controller circuitry and column controller circuitry. As will be appreciated, a processor may be any means, such as a general purpose or special purpose computing system, or may be a hardware configuration, such as a dedicated logic circuit, integrated circuit, Programmable Array Logic, Application Specific Integrated circuit or any device that provides known voltage outputs on corresponding row and column lines in response to known inputs.

In this specific embodiment, the threshold voltage is 10 volts. However, it would be appreciated that the threshold voltage for electron flow depends on the material selected for emitter layer 140. Hence, although the characteristics of the present invention is presented with regard to an carbon nanotube, it would be known by those skilled in the art to substitute another suitable material for emitter layer 140 and adjust the threshold voltage accordingly.

Efficiency of the display may be determined as the power provided to the anode or ITO layer 180 and the power necessary to drive the display: Accordingly efficiency may be determined as:

$$\eta = \frac{I_a V_a}{I_a V_a + I_e V_r}$$

Although $I_e$ is larger than $I_a$, the efficiency remains significantly high as the value of $V_r$ is significantly lower than $V_a$.

The brightness of the FED display may be determined as $$B = \frac{\eta I_a V_a}{\pi A}$$

where A is the area of the spot size on phosphor layer 195.

The emitter comprising the carbon nanotubes placed on the conductor 150 has several advantages over the emitters comprising edge emitter layers such as those disclosed in the embodiments of U.S. Pat. No. 6,693,386; the disclosure of which is incorporated herein in its entirety. One advantage is that the operating voltage between the emitter and the reflector will be reduced. The reduction in the operating voltage between the emitter and the reflector is a result of the carbon nanotubes having a higher Field Enhancement Factor (beta coefficient) than that of the edge emitters made of molybdenum disclosed in U.S. Pat. No. 6,693,386. The Field Enhancement Factor reflects how well the electric field focuses, resulting in a lower threshold voltage. The higher Field Enhancement Factor is mainly a result of the carbon nanotube shape (large aspect ratio and pointed tip) and its carbon construction. This lower operating voltage between the emitter and the reflector will allow operating with a lower voltage display driver integrated circuits, which are less expensive. Also, operation with lower voltages reduces the chance for electrical breakdown.

Another advantage is that the carbon nanotubes are much more stable than that of other materials such as Molybdenum. A further advantage is that the manufacturing of the flat panel display using the carbon nanotubes requires less photolithography steps because the well defined Molybdenum edge emitter of U.S. Pat. No. 6,693,386 is no longer required, resulting in lower manufacturing costs.

The addition of using a TFT over a passive matrix would result in lower peak current per pixel. This is because in a passive matrix design each pixel is driven only during its respective row selection time. For a display with 1024 rows the respective pixels on a single row are driven only 1/1024 percent of the time. When using a TFT because of the associated pixel memory, each on-pixel is driven 100 percent of the time. This will result in a further reduction in the display operating voltage.

The TFT also allows for controlling the color level of each pixel by the voltage stored in the pixel memory cell as opposed to modulating each pixel on and off to control the color level in a passive display. This results in more color control.

While there has been shown, described, and pointed out, fundamental novel features of the present invention as applied to preferred embodiments thereof, it will be understood that various omissions and substitutions and changes in the apparatus described, in the form and details of the devices disclosed, and in their operation, may be made by those skilled in the art without departing from the spirit of the present invention. For example, it is expressly intended that all combinations of those elements which perform substantially the same function in substantially the same way to achieve the same results are within the scope of the invention. Substitutions of elements from one described embodiment to another are also fully intended and contemplated.

What is claimed is:

1. A reflective admission pixel element comprising:

a substrate layer;

at least one reflector layer;

at least one pixel memory cell;

at least one emitter layer, electrically isolated and positioned above a corresponding one of said at least one reflective layer, said at least one emitter layer circumjacent said at least one reflector layer;

at least one thin-film transistor circuit (TFT) applying a first potential to said at least one reflector layer, said first potential being stored in a corresponding one of said pixel memory cell, said first potential determining a color level of said pixel, wherein a potential difference between said at least one emitter layer and said corresponding one of said at least one reflector layer is operable to draw electrons from said at least one emitter layer to said corresponding one of said reflector layer;

a transparent layer oppositely positioned a predetermined distance from said at least one emitter layer, said transparent layer having a conductive layer deposited thereon;

means for applying a second potential to said conductive layer to attract electrons reflected from said at least one reflective layer;

at least one phosphor layer on said conductive layer opposed to said corresponding one of said at least one reflector layer; and wherein said at least one emitter layer comprises a plurality of nanostructures.

2. The pixel element according to claim 1, further comprising:

a vacuum created between said substrate layer and said transparent layer.

3. The pixel element according to claim 1, wherein said nanostructures comprise carbon nanotubes.

4. The pixel element according to claim 1, wherein said at least one reflector layer is selected from a group comprising: aluminum, chromium, niobium, vanadium, gold, silver, and copper.

5. The pixel element according to claim 1, wherein said at least one emitter layer further comprising:

a conductive layer, said nanostructures being placed on said conductive layer.

6. The pixel element according to claim 5, wherein said nanostructures comprise carbon nanotubes.

7. The pixel element according to claim 5, further comprising:

a resistive material imposed between said conductive layer and said nanostructures.

8. The pixel element according to claim 7, wherein said resistive material is an alpha-silicon material.

9. The pixel element according to claim 5, further comprising:

means for selectively applying a third potential to said conductive layer, wherein said third potential is more negative than said first potential.

10. The pixel element according to claim 1, wherein said at least one phosphor layer is a high-voltage phosphor.

11. The pixel element according to claim 10, wherein said at least one phosphor layer is selected from a group consisting of: red, green, and blue.

12. The pixel element according to claim 1, wherein said at least one emitter layer is distributed within said pixel element.

13. The pixel element according to claim 1, wherein said nanostructures laterally extends in close proximity to said at least one reflector layer such that a gap laterally separates said nanostructures and a peripheral edge of said at least one reflective layer.

14. The pixel element according to claim 1, wherein said second potential is selectively applied to selected areas of said transparent layer.

15. The pixel element according to claim 1, wherein said first potential includes a known constant potential and a potential applied as a pulse.

16. The pixel element according to claim 1, further comprising:

means for selectively applying a third potential to said at least one emitter layer, wherein said third potential is more negative than said first potential.

17. The pixel element according to claim 16, wherein a difference between said first potential and said third potential exceeds a known threshold value.

18. The pixel element according to claim 1, further comprising:

a connectivity layer associated with each of said at least one reflective layer, said connectivity layer positioned between said at least one reflective layer and said substrate layer.

19. The pixel element according to claim 18, wherein said second potential is determined to achieve a desired level of image sharpness.

20. The pixel element according to claim 1 wherein said second potential is determined based on said predetermined distance.

21. A reflective edge field emission display (FED) comprising:

a substrate layer having fabricated thereon a plurality of reflective pixel elements arranged in a matrix of rows and columns, each of said pixel elements, identified by a row and column designation, comprising:

at least one reflector layer deposited on said substrate; and an emitter layer, electrically isolated from said reflector layer, and operable to emit electrons, said emitter layer shaped to bound a corresponding one of said at least one reflector layer, said emitter layer comprising a plurality of nanostructures;

a pixel memory cell; and a thin-film transistor circuit (TFT) applying a first potential to said at least one reflector layer, said first potential being stored in said pixel memory cell;

a transparent layer, electrically isolated from said substrate layer, having deposited thereon:

at least one conductive layer; and a phosphor layer associated with each of said at least one conductive layer, wherein said phosphor layer is opposed to a corresponding one of said at least one reflector layer;

at least one non-conductive spacer selectively positioned between said substrate layer and said transparent layer to maintain a substantially desired distance between said substrate layer and said transparent layer; and a seal between said substrate layer and said transparent layer operative to sustain a vacuum therebetween.

22. The FED according to claim 21, wherein said pixel element emitter layers are electrically connected in said rows and said reflector layers are electrically connected in said columns.

23. The FED according to claim 21, wherein said pixel element emitter layers are electrically connected in said columns and said reflector layers are electrically connected in said rows.

24. The FED according to claim 21, further comprising:

means for applying a second potential, determined in relation to said desired distance, to each of said at least one conductive layer;

means for applying a third potential to each of said emitter layers, wherein a potential difference between said first potential and said third potential is operable to attract electrons emitted by an associated emitter layer.

25. The FED according to claim 24, wherein said first potential comprises:

a constant potential and a potential applied as a pulse.

26. The FED according to claim 21, wherein said conductive layer is partitioned into a plurality of electrically isolated strips.

27. The FED according to claim 21, wherein said phosphor layer is a high-voltage phosphor.

28. The FED according to claim 21, wherein said phosphor layer has a minimal amount of sulfur content.

29. The FED according to claim 21, wherein said at least one reflector layer is selected from a group consisting of: gold, silver, aluminum, copper, chromium, niobium, vanadium, and molybdenum.

30. The FED according to claim 21 wherein said at least one reflector layer is niobium.

31. The FED according to claim 21 wherein said nanostructures comprises carbon nanotubes.

32. The FED according to claim 21, wherein said pixel element comprises:

a second layer imposed between said emitter layer and said substrate, said second conductive layer being in electrical contact with said emitter layer and electrically isolated from said at least one reflector layer.

33. The FED according to claim 32, wherein said emitter layer is a resistive material.

34. The FED according to claim 33, wherein said emitter layer is an alpha-carbon.

35. The FED according to claim 32 wherein said resistive element further comprises:

a resistive material imposed between said second conductive layer and said emitter layer.

36. The FED according to claim 35, wherein said resistive material is an alpha-silicon.

37. The FED according to claim 21, wherein a light color emitted by said phosphor layer is selected from a group consisting of: red, blue, and green.

38. The FED according to claim 21, wherein said nanostructures laterally extend in close proximity to a corresponding one of said reflector layer such that a gap laterally separate said nanostructures and a peripheral edge of said corresponding one of said reflector layer.

* * * * *

UNITED STATES PATENT AND TRADEMARK OFFICE

CERTIFICATE OF CORRECTION

PATENT NO. : 8,604,680 B1
APPLICATION NO. : 12/660730
DATED : December 10, 2013
INVENTOR(S) : Krusos et al.

It is certified that error appears in the above-identified patent and that said Letters Patent is hereby corrected as shown below:

In the Claims:

Column 8, line 19, delete “admission” and insert therefor --emission--.

Signed and Sealed this
Eleventh Day of February, 2014

Michelle K. Lee

Michelle K. Lee
*Deputy Director of the United States Patent and Trademark Office*